US006131003A

United States Patent [19]

Cais et al.

[11] Patent Number: 6,131,003

[45] Date of Patent: Oct. 10, 2000

[54] NOISE REDUCING DEVICE FOR PHOTOSENSITIVE DRUM OF AN IMAGE FORMING APPARATUS

[75] Inventors: Rudolf E. Cais; Santanu Debnath, both of Virginia Beach; Dennis C. Working, Norfolk, all of Va.

[73] Assignee: Mitsubishi Chemical America, Inc., Chesapeake, Va.

[21] Appl. No.: 09/316,360

[22] Filed: May 21, 1999

[51] Int. Cl.[7] ..... G03G 15/00

[52] U.S. Cl. ..... 399/91; 399/159

[58] Field of Search ..... 399/91, 116, 117, 399/159

[56] References Cited

U.S. PATENT DOCUMENTS

| | | | |
|---|---|---|---|
| 4,120,576 | 10/1978 | Babish | 399/116 |
| 5,151,737 | 9/1992 | Johnson et al. | 399/117 |
| 5,430,526 | 7/1995 | Ohkubo et al. | 399/159 |
| 5,669,045 | 9/1997 | Swain | 399/159 |
| 5,722,016 | 2/1998 | Godlove et al. | 399/159 |
| 5,960,236 | 9/1999 | Zaman et al. | 399/91 |

FOREIGN PATENT DOCUMENTS

| | | |
|---|---|---|
| 63-60481 | 3/1988 | Japan . |
| 63-155169 | 6/1988 | Japan . |
| 64-31161 | 2/1989 | Japan . |
| 3-105348 | 5/1991 | Japan . |
| 5-35166 | 2/1993 | Japan . |
| 5-188839 | 7/1993 | Japan . |

*Primary Examiner*—William J. Royer

*Attorney, Agent, or Firm*—Oblon, Spivak, McClelland, Maier & Neustadt, P.C.

[57] ABSTRACT

A device and method for reducing noise and/or vibration in an image forming apparatus. In a preferred form, an insert is disposed inside of a photosensitive drum, and the insert is a hollow tubular member including first and second members having surfaces oblique with respect to a longitudinal axis of the photosensitive drum, wherein the surfaces each face each other. The first and second members are moved relative to each other in order to change the overall diameter of the insert, such that upon insertion, the overall diameter can be made smaller than the inner diameter of the drum, and after insertion, the overall diameter of the insert can be increased such that the outer surface of the insert comes into contact with an inner surface of the drum. As such, the insert can be anchored to the interior of the drum without using adhesive and can be easily removed for recycling purposes.

47 Claims, 7 Drawing Sheets

NOISE REDUCING DEVICE FOR PHOTOSENSITIVE DRUM OF AN IMAGE FORMING APPARATUS

TECHNICAL FIELD

The invention relates to image forming apparatus, and particularly to photosensitive drums in which an insert is provided for reducing noise and/or vibration.

BACKGROUND OF THE INVENTION

Discussion of Background

Image forming apparatuses, such as printers or photocopiers, include a photosensitive member, typically in the form of a photosensitive drum. The performance of the photosensitive drum is of critical importance, since the image being produced (or reproduced) is formed and developed on the drum surface. The developed image is then transferred from the drum to, for example, a sheet of paper. Typically, the drum is formed of metal, such as aluminum, and the metal is anodized or coated with a thin dielectric layer. The drum is then coated with photogeneration and photoconduction layers over the dielectric layer.

In forming an image, the drum is rotated, and a given location on the outer surface of the drum is thereby rotated past a charging device, an exposure location, a developing location (at which toner is applied), a transfer location (at which the toner image is transferred from the drum to paper), and a cleaning location at which a cleaning blade removes excess toner from the drum so that the process can be repeated. During an image forming operation, as a result of the rotation of the photosensitive drum, and its interaction with the various other components of the image forming apparatus, noise and vibration can occur. This is particularly true since the photosensitive drum is a thin-walled metal drum, and thus has a characteristic harmonic sound spectrum which is easily driven by any mechanical resonance.

For example, vibration (and associated noise) can occur from the rotation of the drum, and any imperfections of the drum, the gear flanges attached to the drum, and/or the drive which interacts with the gear flanges of the drum. Further, an alternating current (AC) electric field is applied to the charge roller, and the alternating current can also cause noise and/or vibration of the drum or between the drum and other components. In addition, as the drum rotates past the cleaning blade (which is in contact with the drum), noise is often generated, particularly if the drum surface is roughened by use. This interaction between the drum and cleaning blade is also known as chatter vibration or "stick-slip" vibration. (See, e.g., Chatter Vibration of a Cleaner Blade in Electrophotography, by Kawamoto, in the January/February 1996 issue of Journal of Imaging Science and Technology.) The noise and vibration associated with operation of a photoconductive drum not only presents an annoyance to workers using (or in the vicinity of) the image forming apparatus, but also, the noise/vibration can lead to image deterioration or damage to the apparatus. In particular, the vibration can result in poor performance or interaction between the photosensitive drum and one or more of the components with which the drum interacts, including the cleaning blade, the charge roller, the developer device, etc. Vibration may cause image blurring especially with the current trend to higher resolution devices (evolution from 300 to 1200 dots per inch). For example, if the cleaning blade does not properly remove residual toner, undesirable resolution of character images can occur in subsequent images. Further, if the drum is not charged or developed properly, the resulting image can have white spaces where the image has not been properly formed, developed or transferred, or black spots where undesired toner has been transferred to the sheet of paper. Noise problems can also occur as a result of the generation of gases (ozone) which occurs during an image forming operation, however this noise is typically relatively small.

To eliminate noise and/or vibration, the physical characteristics of the drum can be modified, for example, by increasing the thickness of the drum. Thus, the drum can be designed so that its natural frequency differs from that of other components of the apparatus and/or that of the process cartridge (the unit within which the drum is disposed). As a result, the vibrations are eliminated or reduced, or the frequency of the noise which might occur can be shifted so that it is outside of the audible range. However, increasing the thickness of the drum can make the drum more expensive to manufacture, particularly if the tooling utilized to manufacture a drum must be replaced. Moreover, when photosensitive drums are manufactured as replacement parts, they will often be inserted into process cartridges of another manufacturer. The process cartridge could be refurbished or a newly manufactured replacement process cartridge of a different manufacturer than that of the photosensitive drum, and the manufacturer/refurbisher of the process cartridge could change (or the design of a given manufacturer/refurbisher could change). Thus, it can be difficult to simply select a thickness of the drum which will be suitable for avoiding noise problems, since even if a thickness is selected for a certain process cartridge, that thickness could be unsuitable for another process cartridge. As a result, noise problems can be particularly problematic with photosensitive drums manufactured as replacement parts.

A further difficultly which can arise with photosensitive drums is that the roundness or circularity of the drum can vary over time, which can also lead to image deterioration. The roundness or circularity of the drum can more rapidly deteriorate if the drum is vibrating and contacting other components disposed about the drum. This problem can also be reduced by providing a thicker drum, however as discussed above, increasing the thickness of the drum can increase the cost, from a materials standpoint and/or the requirement for new tooling.

An alternate solution which has been utilized in the past for solving noise and/or vibration problems has been to insert plugs within the photosensitive drum. U.S. Pat. No. 5,488,459 to Tsuda et al. discloses an example of such an approach. With this solution, a disk or cylindrical object is inserted into the drum, and the insert provides additional weighting to the drum to alter the mass/frequency characteristics of the drum. However, the use of plug-type inserts is undesirable for a number of reasons. First, the plug is often required to be positioned at a precise location within the drum, which can complicate the manufacturing process. Further, the plug must be secured in place, which can require the use of an adhesive, thus further complicating the manufacture/assembly process. Further, the plug must be precisely manufactured. If it is too large, it could cause deformation of the drum, or require a high insertion force, which complicates the assembly process.

For example, it is ideal to use expanding chucks to hold a photoconductive drum by its inner surface during certain manufacturing processes, since damage to the outer surface of the drum is prevented. However, expanding chucks have limited holding ability. Therefore, if a high insertion force is required to insert a plug into a photoconductive drum, it may not be possible to use an expanding chuck to hold the drum during insertion without distorting the shape of the drum. On the other hand, if the plug is too small, it can be difficult to position the plug within the drum and secure the plug in place. Thus, the use of a plug or weight which is inserted inside of the drum has been less than optimal.

Another problem that has arisen with respect to inserts that are either bonded or secured to the inside of a photoconductive drum by an interference, is that in recycling such equipment, dissimilar materials must be separated from each other. For example, photoconductive drums are typically made from aluminum, while inserts are typically made of rubbers, plastics or foams, etc. Therefore, in order to recycle the drum, the drum must be separated from the insert. If, however, the insert has been bonded to the inside of the photoconductive drum with an adhesive, extreme measures must be taken to remove the insert from the drum. Similarly, if the insert has been anchored to the inside of the photoconductive drum via an interference fit, it can be difficult to remove the insert from the inside of the drum.

Similar problems arise with respect to the mounting of end pieces to a photosensitive drum, such as gears and/or flanges. For example, if a gear is attached to the end of a photosensitive drum, to provide an interface with a toothed gear of a motor, and thereby transmit rotational forces to the drum, the gear must be anchored with sufficient strength to withstand such rotational forces over its useful life span. It has been well-known to use adhesives, interference fits, or to cut an end of the drum to provide a key way, or other mechanical interlacing of the gear and drum. However, the use of adhesives and interference fits, cause problems discussed above with respect to drum inserts. Furthermore, specialized machining of the drum ends may require special tooling.

In view of the foregoing, a device and method are needed for reducing noise and/or vibration in image forming apparatus, particularly noise and/or vibration associated with operation of a photosensitive drum. Such a device and method are preferably suitable for use in both original equipment and for replacement parts.

SUMMARY OF THE INVENTION

It is an object of the present invention to provide a device and method for reducing noise and/or vibration in an image forming apparatus.

It is another object of the invention to provide a device and method for eliminating or reducing noise or vibration which can occur during operation of a photosensitive drum in original equipment of an image forming apparatus, or during operation of replaced or refurbished parts of an image forming apparatus.

It is a further object of the invention to provide a device and method which will provide for more reliable and consistent performance of a photosensitive drum in an image forming apparatus.

It is a further object of the invention to provide an insert device for a photosensitive drum which can be easily installed inside of a photosensitive drum, without requiring the insert to be bonded within the drum.

It is yet another object of the invention to provide a drum with an insert and an end piece such as a gear and/or flange which does not require adhesive or special machining of the drum to anchor the end pieces or the insert to the drum.

The above and other objects and advantages are achieved in accordance with the present invention by providing a noise prevention device inserted into a photosensitive drum and which is constructed of at least two members which have a surface oblique with respect to the longitudinal axis of the photosensitive drum, and wherein the surfaces face each other. As a result, since the first and second members have a surface oblique with respect to the longitudinal axis of the drum, the first and second members can be constructed and arranged in such a way that the outer diameter of the noise prevention device can be changed by moving the first and second members relative to each other. Constructed in this manner, the noise prevention device is selectively expandable so that, among other advantages, it can be inserted with zero insertion force, yet maintain its position within the photosensitive drum without adhesive. Therefore, the complication associated with using adhesive to bond an insert to the interior of a photosensitive drum are avoided and recycling of the drum is simplified since the insert may be removed relatively easily. Furthermore, since the insert can be inserted with zero insertion force, the drum is rendered more durable and less susceptible to deformation or deviation in roundness about the circumference of the drum.

In a presently preferred form of the invention, the first and second members are wedge shaped and the inclined surfaces of the first and second members are in mutual contact with each other such that a reaction force directed from the tubular photosensitive member acting on the first and second members is balanced by a component of a frictional reaction force generated between the oblique surfaces. Therefore, the insert maintains its position within the tubular photosensitive member by a frictional force between the first and second members, which therefore avoids the need for an adhesive to be used to maintain the position of the insert within the photosensitive member. For example, when inserts are made from a rigid material and with a diameter that is less than that of the inner surface of the photosensitive member, it has heretofore been impossible to anchor the insert within the photosensitive member without adhesive or another device for engaging the inner surface of the photosensitive member. However, by forming the first and second members in the shape of a wedge such that a frictional force between the first and second members maintains the radially outward force necessary for anchoring the insert within the photosensitive member, the present invention avoids the need for adhesive and provides an insert that is relatively simple to insert into a photosensitive member.

In another preferred embodiment of the present invention, the inclined surfaces of the first and second members each have at least one tooth so that when the inclined surfaces of the first and second members are in mutual contact, the teeth may be engaged with each other so as to maintain a predetermined relative position between the first and second members. By including at least one tooth on the inclined surfaces of the first and second members, it is easier, during the insertion of the insert into a photoconductor drum, for example, to identify and achieve a predetermined desired position between the first and second members. For example, when such inserts are inserted into a photoconductive drum, it is desirable to insert the members such that a predetermined outward radial force is generated which is sufficient to cause enough contact between the insert and the drum to dampen noise, without generating an outward radial force that is so large that the shape of the drum is deformed. Therefore, if the inclined surfaces of the first and second members are provided with one tooth each, positioned so as to correspond to a predetermined radially outward force when the first and second members are arranged such that the teeth engage with each other, a worker who or a machine which is inserting the insert into a photoconductive drum, can easily identify the predetermined desired position for the first and second members. Therefore, greater uniformity of the outward radial force generated by the insert can be achieved from unit to unit.

Preferably, the inclined surfaces of the first and second member are provided with a plurality of teeth which thereby ensures that the first and second members remain anchored in their relative position when the teeth are engaged with each other. Furthermore, since a single tooth may tend to cause variation in the alignment of the first and second members with each other, if the teeth are uniformly distributed over the inclined surfaces, uniform contact between the outer peripheral surface of the insert and the inner surface of the drum can be ensured.

In another preferred embodiment of the present invention, the outer peripheral surface of the first and second members are provided with deformable ribs on their outer peripheral surfaces. By providing ribs such as annular ribs on the outer peripheral surface of the first and second members, the contact area between the first and second members and the inner surface of a photoconductive drum can be enlarged in the circumferential direction. This is particularly true where the first and second members are made from a substantially rigid material, which would result in a contact area of limited size. However, by providing deformable annular ribs on the outer peripheral surface of the first and second members, upon insertion and tightening of the insert within the photoconductive drum, the annular ribs may deform and generate a contact area with the inner peripheral surface of the photoconductive drum which generally extend in circumferential arcuate directions, thereby enhancing vibration and noise dampening. Such annular ribs can be made from an elastomeric material or can be formed monolithically with the first and second members. Furthermore, annular ribs can be provided on first and second members which also have at least one tooth on their inclined surfaces, thereby combining the effects of the annular ribs and the teeth.

According to another aspect of the invention, an insert for a photoconductive drum may be constructed of a tubular member having a plurality of annular ribs provided on its outer peripheral surface. In the presently preferred embodiment of this aspect of the invention, the annular ribs are formed monolithically with the tubular member and are deformable. In this embodiment, the deformable ribs are provided with an outer diameter, in a relaxed state, which is greater than the inner diameter of the photoconductive drum. Upon insertion, the ribs are therefore compressed which thereby generates a radially outward force for anchoring the insert to the inside of the drum. Furthermore, the ribs may vary in size along the axial direction of the insert. Preferably, the ribs provided at the ends of the insert are larger than the ribs toward the middle of the insert. This allows the insertion force to be kept as low as possible, while ensuring a tight fit between the insert and the inner surface of the drum.

One method for creating such deformable and monolithically formed ribs is to form a tubular member having an outer diameter which is less than the inner diameter of the photoconductive drum, then turning the tubular member on a lathe, for example, and making annular cuts into the outer surface of the tubular member, so as to raise some of the material and thereby form a rib with an outer diameter which is greater than or equal to the inner diameter of the drum. The construction of such an insert is quite simple and only requires one material. Furthermore, since only the annular ribs have an outer diameter which is equal to or greater than the inner diameter of the drum, the resulting radially outward force is limited to the areas of contact between the ribs and the drum, and is therefore less likely to produce deformation of the drum. Preferably, the ribs are constructed so that the outer diameter of the ribs varies along the axial length of the insert. For example, the outer diameter of the ribs at the ends of the insert are made larger than the outer diameter of the ribs towards the middle of the insert. Constructed in this way, the insertion force needed for inserting the insert into the drum is kept as low as possible, while the larger ribs at the ends of the insert ensure that there is a tight fit between the insert and the inner surface of the drum. In an alternative embodiment, any of the above-described annular ribs may be bonded to the exterior of the tubular member, wherein the annular ribs are made of an elastomeric material. By forming the annular ribs of an elastomeric material, sufficient anchoring of the insert within the drum may be achieved with generally less outward radial force since elastomeric material tends to deform and spread more readily than rigid materials, and thereby form large areas of contact with little pressure. Elastomeric ribs also tend to force air pockets out from between the ribs and the inner surface of the drum, thereby producing a slight suction effect between the ribs and the drum, and thereby enhancing the anchoring of the insert to the inner surface of the drum.

The arrangement of the present invention is advantageous in a number of respects. First, since the outer surface of the insert is in contact with the inner surface of the photosensitive drum, the insert can vary the mass/frequency characteristics of the drum, to thereby ensure that the resonance frequency of the drum is outside of the audible range, or does not match the resonance frequency of other components of the apparatus. Further, since the first and second members of the noise prevention device can have a diameter less than that of the inner surface of the drum, the noise prevention device can be inserted with zero insertion force, thereby preventing damage during the assembly of the drum with the noise prevention device. A further advantage is that the drum and insert material can be easily recycled, since it is not necessary to use an adhesive to bond the insert with the interior of the drum.

BRIEF DESCRIPTION OF THE DRAWINGS

Other objects and advantages of the present invention will become apparent as the same becomes better understood with reference to the following detailed description, particularly when considered in conjunction with the drawings in which.

DETAILED DESCRIPTION OF THE PREFERRED EMBODIMENTS

Figure 1:
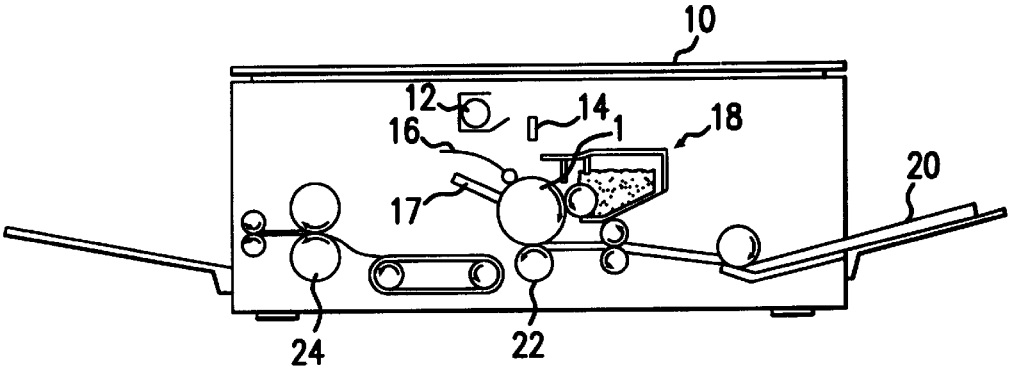
FIG.1 (PRIOR ART)
FIG. 1 schematically represents a photocopier to which the present invention is applicable.

FIG. 1 schematically represents an image forming apparatus in the form of a photocopier to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing a charge roller 16. As a result, an electrostatic latent image is formed on the drum l,and a developing unit 18 then supplies toner to the drum 1 to develop the electrostatic latent image. Paper is fed from a source 20 by various rollers to a location between the drum 1 and a backup roller 22, so that the toner image of the drum is transferred to the paper. The paper is then fed to a fixing device 24 which, typically utilizing heat, fixes the toner image to the paper and the paper is then conveyed out of the apparatus. A cleaning blade 17 is provided downstream from the backup roller 22 (i.e., downstream with respect to the direction of rotation of the drum 1), so that any residual toner remaining on the drum after the image is transferred to the sheet is removed by the cleaning blade 17. The toner removed by the blade then falls into a container (not shown) provided for collecting residual toner. The drum is then provided with an initial charge by the charge roller 16, and the process is repeated for the next image.

Figure 2:
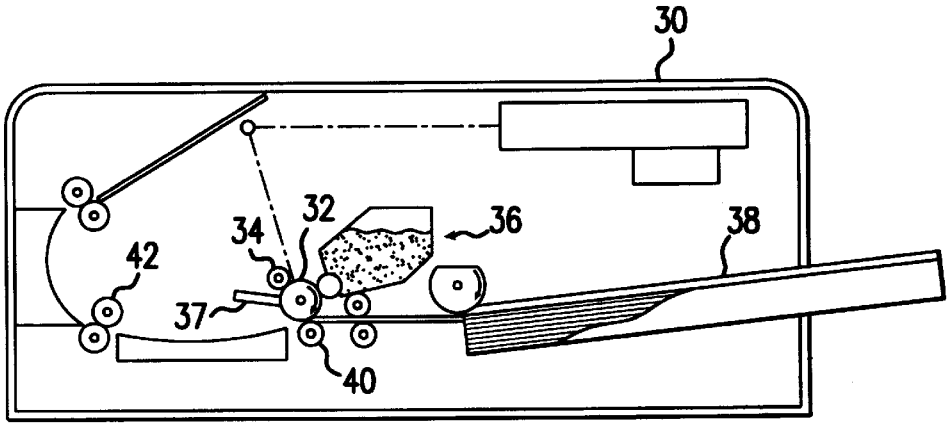
FIG.2 (PRIOR ART)
FIG. 2 schematically represents a printer to which the present invention is applicable.

FIG. 2 schematically represents a printer device to which the present invention is also applicable. As shown in FIG. 2, in contrast with the photocopier device, the printer provides an image by way of a control unit which provides a video signal, for example, by a laser scanning unit 30. The laser scanning unit 30 thus provides a latent image onto the photosensitive drum 32, which has been uniformly charged with a charge roller 34. The image is developed by a developing device 36, and is transferred to paper, which is fed from a source 38, as the paper passes between the photosensitive drum 32 and a backup roller 40. The paper then travels past a fixing device 42 and out of the printer by various conveying rollers and guides. Residual toner can be removed by a cleaning blade 37.

As should be apparent from the foregoing, the photosensitive drum is critical to the image forming process, and for each cycle of operation, the photosensitive drum is required to cooperate and interact with a number of components, including the charge roller, the optical image forming system, the developing device, the backup roller and the cleaning blade. As the drum rotates, it can also vibrate as a result of the drive utilized in rotating the drum, imperfections in the drum and/or the gear flanges of the drum, etc. Further, where an AC current is applied to the charge roller 16, 34, the alternating charge can also have a tendency to cause vibration and/or noise during operation of the drum, as can the frictional contact of the drum with the various components including the cleaning blade, charge roller and developing device. The operation of a charge roller has also been found to generate ozone gas by localized electric discharge (known as the Paschen discharge effect), and this discharge is also believed to be a potential cause for noise and/or vibration of the drum.

The generation of noise and/or vibration is often accompanied by a deterioration in the image quality, since the drum is not smoothly and consistently interacting with the other components of the image forming apparatus. As a result, toner may appear in areas in which it is not desired (undesirable black spots), and/or toner will not appear in areas required for forming the image (undesirable white spots). Less than optimal images can also occur over a period of use as the circularity of the drum diminishes. In particular, after the drum has operated for a number of cycles, certain locations of the drum can become deformed so that the cylindrical shape of the drum becomes more imperfect. This loss of circularity also contributes to degradation of the image quality, and the loss of circularity can occur more rapidly if the drum vibrates, since the drum can be exposed to more concentrated forces or forces of a larger magnitude than would be the case if the drum were smoothly rotated. Of course, the generation of undesirable noise and vibration can also be an annoyance to the operator of the apparatus, or those in the vicinity of the apparatus.

In order to avoid or reduce noise, some equipment manufacturers have designed the drum so that the natural resonance frequency of the drum does not match that of any of the surrounding components, and also so that the natural resonance frequency of the drum is not in the audible range. As a result, if vibration should occur, it is less destructive, since the frequency does not match that of the surrounding components. In addition, the noise is not audible (or is less likely to be audible) to the operator or those in the vicinity of operation of the apparatus. However, if a noise problem is found to occur in existing equipment, it can be quite costly to redesign tooling necessary to change the dimensions (e.g., the tube thickness) of the drum. Further, even if the tube thickness is modified, such a solution might not be satisfactory in addressing noise and/or vibration in all replacement parts situations, since the process cartridge (within which the drum is disposed) can vary with different manufacturers and models, and the manufacturer or refurbisher of process cartridges (or other components) is not always the same as that of the photosensitive drum.

Another approach to minimizing noise and/or vibration in photosensitive drums has been to insert a plug or weight at a predetermined location within the drum. However, the use of a plug-type insert can be undesirable in that the plug is typically required to be inserted at a particular axial location within the drum, and if improperly placed, the plug will not perform properly, and could even worsen the noise or vibration problems. In addition, the plug must be either adhered in place, or an interference fit can be utilized so that the plug is secured in place once inserted. Fixing the plug with an adhesive can be cumbersome, and could result in the adhesive being inadvertently disposed at locations other than desired, or the plug could shift if the drum is transported prior to curing of the adhesive. Bonding the insert to the drum also complicates recycling of the drum. If an interference fit is utilized, the drum could be deformed upon insertion. Further, since the drum is supported at the location of the plug, but not in other areas, the performance and response of the drum at the location of the plug might not be consistent with that of locations of the drum other than that where the plug is disposed.

Another problem that has arisen is that the photosensitive coatings on the outer surface of the drums can be damaged when they are engaged by tools used to hold the drum during a manufacturing process. Therefore, it has been known to use an expanding chuck to hold the drum while a process is being performed on it by expanding the expanding chuck against the inner surface of the drum. However, if a high insertion force is required for a particular insert, the expanding chuck must exert a correspondingly large radially outward force in order to overcome the insertion force, to thereby hold the drum in a proper orientation. Furthermore, if an insert requires a high insertion force because its outer diameter is larger than that of the inner diameter of the drum, the circularity of the drum can be distorted during insertion. Therefore, ideally, an insert is inserted with zero insertion force, i.e., the insert does not contact the inner surface of the drum during insertion.

Figure 3:
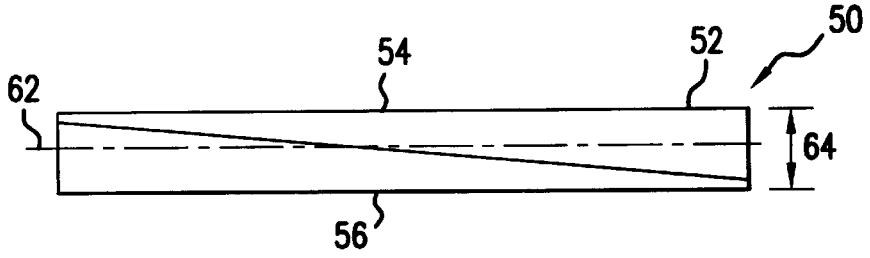
FIGS. 3 through 6 are side views of an insert for a photoconductive drum of the present invention.
Figure 4:
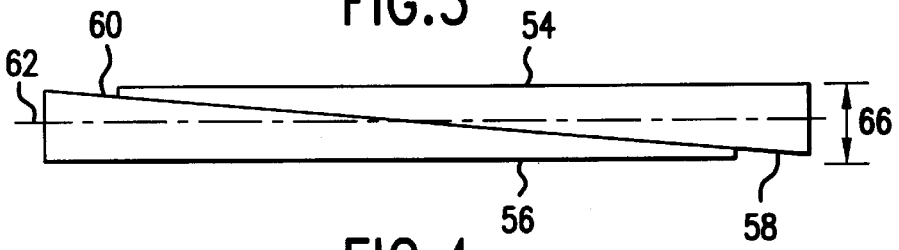
Figure 5:
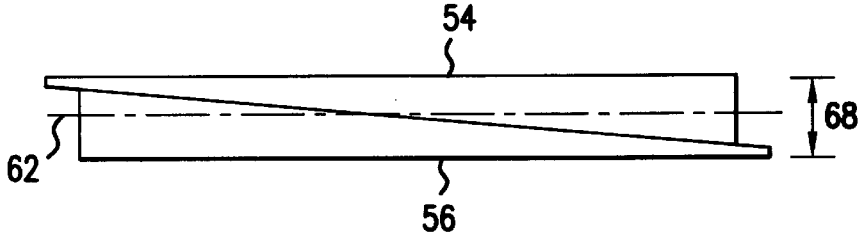
Figure 6:
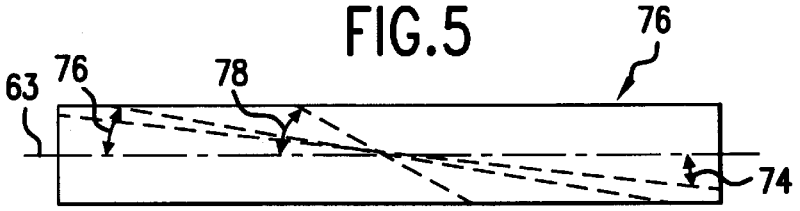
Figure 7:
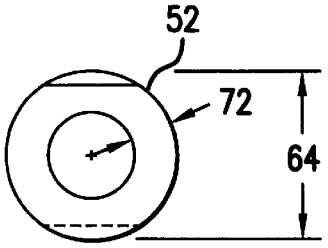
FIG. 7 is an end view of the insert shown in FIGS. 3 through 6.

Referring now to FIGS. 3 through 6, insert 50 in accordance with the present invention is shown therein. As shown in FIGS. 3 and 7, insert 50 is formed as a tubular member having a first member 54 and a second member 56 each having surfaces, 58 and 60, respectively, oriented obliquely with respect to longitudinal axis 62 of the insert 50. As shown in FIGS. 3 through 6, first and second members 54 and 56 in a presently preferred form are wedge shaped, such that the outer overall diameter of insert 50 can be changed by moving first and second members 54 and 56 relative to each other, along longitudinal axis 62.

In a presently preferred embodiment, first and second members 54 and 56 are formed by cutting a pipe 76 along a direction oblique with respect to the longitudinal axis 63 of pipe 76, thereby forming two wedge shaped members 54 and 56.

Figure 13:
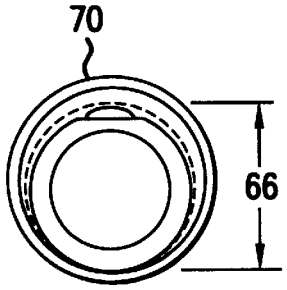
FIGS. 13 and 14 are end views of a photosensitive drum having an insert disposed therein in accordance with the present invention.
Figure 14:
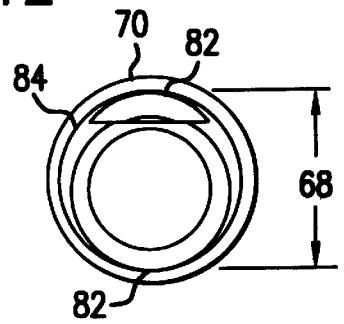

For example, as shown in FIGS. 3 and 7, when members 54 and 56 are aligned such that the outer circumference of insert 50 resembles the shape of the original pipe from which members 54 and 56 were cut, the overall diameter 64 of insert 50 is approximately the same as that of the original pipe 76 cut to form first and second members 54 and 56. However, when the first and second members 54 and 56 are moved generally away from each other along axis 62, while maintaining contact between surfaces 58 and 60, the overall diameter 66 of insert 50 is smaller than diameter 64. On the other hand, if first and second members 54 and 56 are moved generally towards each other along axis 62, overall diameter 68 of insert 50 is larger than diameter 64. Diameters 66 and 68 are also shown in FIGS. 13 and 14, illustrating the expansion of the overall diameter of insert 50 while it is inside the drum 70. It is important to note that although the outer circumferential surface of insert 50 may not be continuously circular, an overall diameter of the insert can be designated as the diameter of the smallest possible circle which can enclose the outer circumferential surface of insert 50, as shown in FIGS. 13 and 14. In FIG. 13, diameter 66 is represented as a dashed circle, while diameter 68, in FIG. 14, coincides with inner surface 84 of drum 70.

Figure 8:
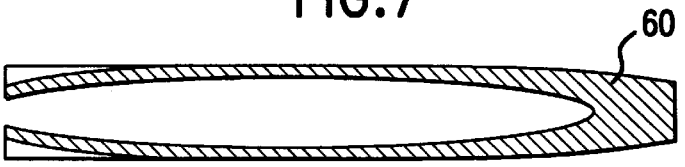
FIG. 8 is a top plan view of one of two members of the insert shown in FIGS. 3 through 5.

Preferably, first and second members 54 and 56, are cut from commercially available pipe, such as PVC piping. Furthermore, the pipe used to form first and second members 54 and 56 has approximately a one-eighth inch thick wall thickness 72, although the wall thickness 72 can vary greatly. However, by constructing first and second members 54 and 56 from a pipe having a wall thickness 72 of at least one-eighth inch, the resulting surfaces 58 and 60 provide a large amount of surface area, as shown in FIG. 8. Furthermore, it is preferable that the outer diameter of members 54 and 56, or the outer diameter of pipe 76 where members 54 and 56 are cut from pipe 76, are less than an inner diameter 118 (FIG. 11) of drum 70. Constructed as such, it is possible to guide insert 50 into drum 70 with zero insertion force. However, in order to provide the maximum possible contact between the outer circumferential surface 82 of insert 50 and the inner surface 84 of drum 70, the outer diameter of pipe 76 should be as close as possible to inner diameter 118 of drum 70. In light of well known machining tolerances, it is preferable that the outer diameter of member 54 and 56 are at least 0.005 inches less than inner diameter 118 of drum 70.

Furthermore, it is also preferable that the angle 74 at which the original pipe 76 is cut so as to form first and second members 54 and 56 is of a sufficient magnitude such that the surfaces 58 and 60 extend over substantially the entire length of insert 50. Alternatively, pipe 76 could be cut at other angles such as 76 and 78 which yield surfaces that are shorter than insert 50. However, the maximum angle that can be used will ultimately be limited by the resulting frictional forces directed along surfaces 60 and 58 and the radially outward force needed to anchor insert 50 to the inner surface of drum 70. For example, referring now to FIG. 10, when insert 50 is inserted into drum 70 and first and second members 54 and 56 are moved relative to each other along axis 80 of drum 70, such that the outer surface 82 of insert 50 is in contact with inner surface 84 of drum 70, insert 50 imparts a radially outward force 86 on the inner surface 84 of drum 70. Accordingly, a reaction force 88 is exerted on insert 50 by drum 70. Therefore, with respect to surfaces 60 and 58 reaction force 88, acting on surfaces 58 and 60, can be expressed as a shearing force 90 directed parallel to surfaces 60 and 58 and a normal force 92 which is directed perpendicular to surfaces 60 and 58. In order to overcome shearing force 90, frictional force 94 generated at the inner face of surfaces 58 and 60 must be at least as large as shearing force 90. However, as the angle between surfaces 58 and 60 and longitudinal axis 62 is increased, the resulting shearing force 90 increases while normal force 92 decreases. It is well-known that frictional force equals a frictional coefficient times the normal force. Therefore, since normal force 92 decreases as the angle between surfaces 58 and 60 increases, the frictional force generated at the inner face of surfaces 58 and 60 decreases according to the well-known relationship. It is conceived that one of ordinary skill in the art could simply determine the maximum angle possible for any particular coefficient of friction associated with material used for pipe 76. In any event, it is preferable that the surfaces 58 and 60 extend substantially over the entire length of insert 50, since such a construction would provide contact over the maximum possible length of drum 70, and therefore maximize noise dampening.

Once insert 50 has been inserted into drum 70, first and second ends 96 and 98 of drum 70 can be provided with end pieces 100 and/or 102, such as gear 106 and/or flange 110, or any combination thereof. Typically, gear 106 is provided to a drum 70 so as to provide an interface to a motor (not shown) for driving drum 70. Flange 110, is typically provided so as to provide a bearing surface for supporting drum 70. Alternatively, second end 98 of drum 70 could also be provided with a gear 106 which may be used for driving other rollers or gears. In any event, typically gears 106 and flanges 110 have been bonded to the inner surface 84 of drum 70 with an adhesive. However, use of an adhesive raises a number of problems in the manufacture of photosensitive drums.

For example, if adhesive must be used during the manufacture of a photosensitive drum, the risk that adhesive can be splashed onto the outer surface 104 of drum 70, is increased, which may require that drum 70 be immediately discarded. Furthermore, adhesives may affect the photosensitivity and/or performance of drum 70 in operation. Furthermore, when an adhesive is used to bond a component to a drum such as drum 70, it is difficult to remove such components when a drum 70 is to be recycled. Therefore, it is desirable to avoid the use of adhesives.

Figure 9:
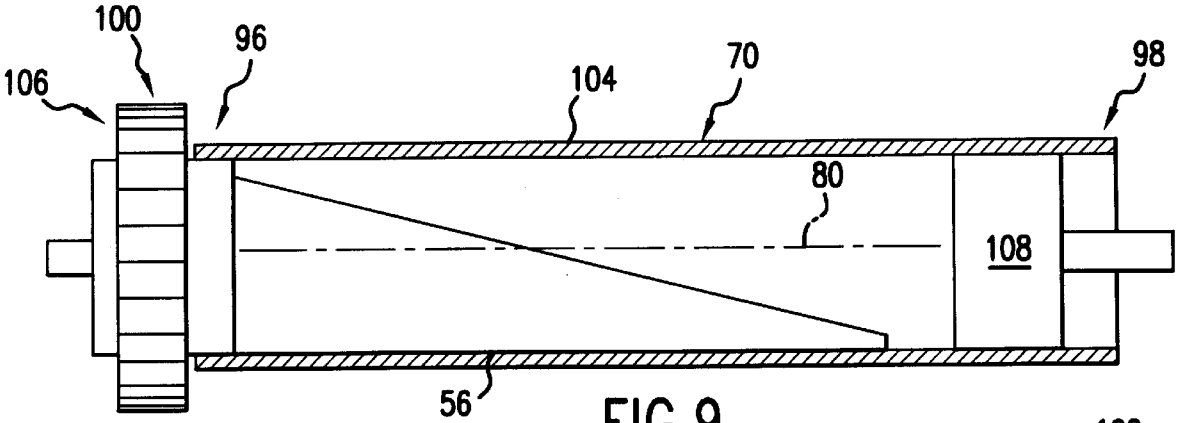
FIG. 9 is a partially cross-sectioned view of a photosensitive drum with a side view of a portion of an insert disposed therein, in accordance with the present invention.
Figure 10:
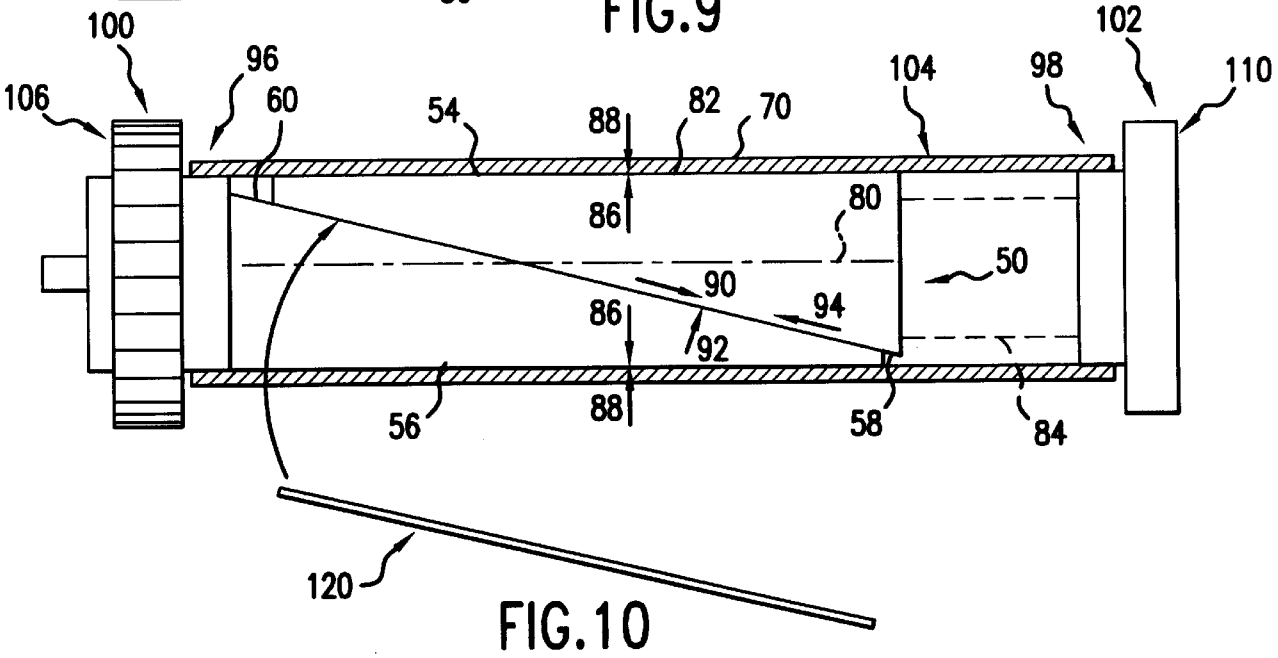
FIG. 10 is a partially cross-sectioned view of a photosensitive drum and a side view of an insert disposed therein, in accordance with the present invention.

Alternatively, referring again to FIGS. 9 and 10, member 56 of insert 50 may be made integrally with end piece 100 such as gear 106 and inserted into drum 70 through first end 96 of drum 70. Preferably, drum 70 is held in place by a mechanism such as an expanding chuck 108 so as to avoid the need to clamp a holding device to the outer surface 104 of drum 70. After member 56 has been inserted as such, expanding chuck 108 may be removed and member 54 may be inserted from second end 98 of drum 70 as shown in FIG. 10. Once member 54 has been inserted and moved relative to member 56 along axis 80, such that the outer surface 82 of insert 50 is in contact with inner surface 84 of drum 70, insert 50 can be sufficiently anchored to the inner surface 84 of drum 70 such that no adhesive is needed to anchor insert 50 and gear 106 as such. For example, member 54 can be inserted until radially outward force 86 is generated which is sufficient to generate a friction force 94 which overcomes shearing force 90. Furthermore, radially outward force 86, can be generated so that insert 50 is sufficiently anchored to overcome any rotational forces imparted to insert 50 via gear 106, or any motor attached thereto. Therefore, gear 106 and insert 50 can be attached to drum 70 without the need for any adhesive coming in contact with drum 70. After member 54 has been inserted as such, end piece 102 such as flange 110 may be inserted and bonded to the interior surface 84 of drum 70. However, if it is desired to avoid any use of adhesive in contact with inner surface 84 of drum 70, end piece 102 such as flange 110 may be formed integrally with member 54, as illustrated by the dashed lines shown in FIG. 10. By constructing member 54 and end piece 102 as such, no adhesive is required to rigidly engage insert 50 and end pieces 100 and 102 with drum 70.

It is also conceived that a third member 120, may be inserted between oblique surfaces 58 and 60 to achieve a desired frictional coefficient or alignment between members 54 and 56. For example, if members 54 and 56 are made from material A, the frictional coefficient between surfaces 58 and 60 would be $\mu_A$. However, if member 120 is made from material B which has a frictional coefficient $\mu_{A\text{-}B}$ when in contact with material A, which is higher than $\mu_A$, the frictional force 94 generated along surfaces 58 and 60 will equal normal force 92 times $\mu_{A\text{-}B}$, resulting in a higher frictional force between members 54 and 56. However, in order to minimize the number of components that must be aligned during assembly, it is preferable that surfaces 58 and 60 are placed in mutual contact.

Referring again to FIGS. 9 and 10, it has been found that since either one or both of members 54 and 56 move radially outwardly as they are moved relative to each other to increase the overall diameter of insert 50, it is preferable that either one or both of members 54 and 56 are elastically attached to end pieces 100 or 102. Such elastic attachment could be in the form of elastic adhesive or an elastic member interposed between members 54 and 56 and end pieces 100 and 102, respectively. By providing some form of elastic engagement between members 54 and 56 and end pieces 100 and 102, misalignment of end pieces 100 or 102 such as gear 106 and/or flange 110 is prevented. Furthermore, such an elastic attachment allows members 54 and 56 to achieve contact with inner surface 84 of drum 70 along substantially their entire length.

Figure 11:
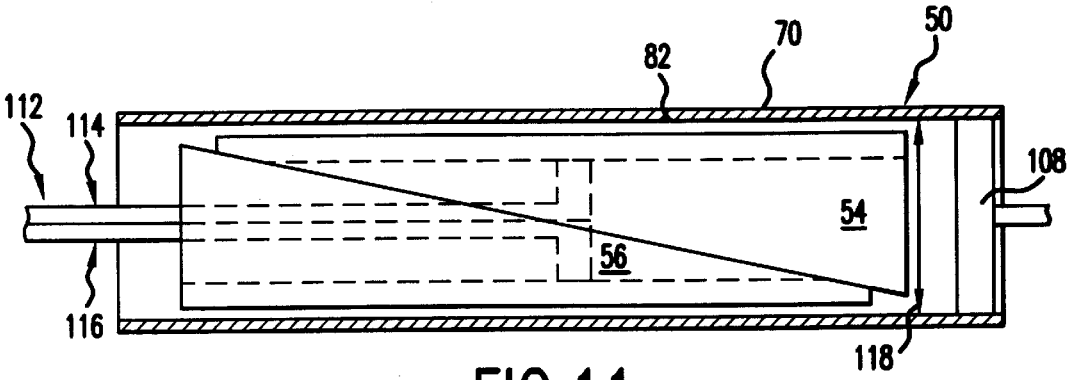
FIGS. 11 and 12 are partial cross-sectioned views of a photosensitive drum and a side view of an insert disposed therein, in accordance with the present invention.
Figure 12:
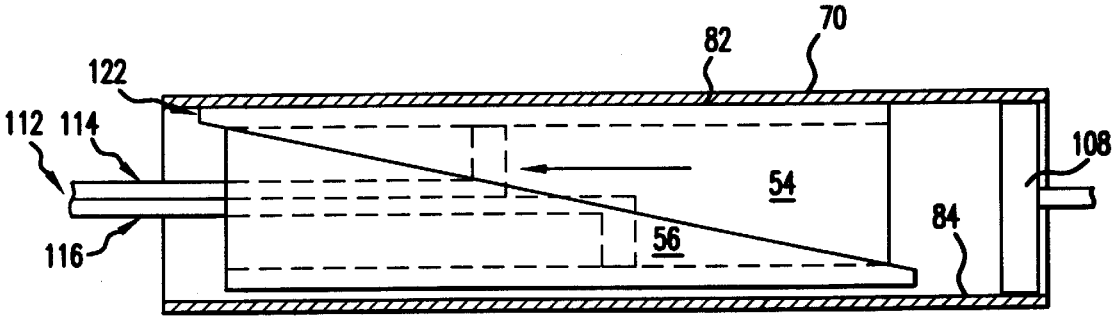

Referring now to FIGS. 11 and 12, an alternative method for inserting insert 50 into drum 70 is set forth below. As shown in FIG. 11, an insertion jig 112 includes first jig member 114 and second jig member 116 which are configured to releaseably engage with first member 54 and second member 56, respectively. Upon insertion of insert 50 into drum 70, insertion jig members 114 and 116 are engaged with members 54 and 56 and arranged such that the overall diameter 66 of insert 50, as shown in FIG. 13, is less than the inner diameter 118 of drum 70. After insert 50 has been positioned as desired, jig member 114 is moved relative to jig member 116 so as to slide member 54 relative to member 56 so that the overall diameter 68, as show in FIG. 14, is of such a magnitude that outer surface 82 of insert 50 contacts inner surface 84 of drum 70. Afterwards,jig members 114 and 116 are disengaged from members 54 and 56 and removed from the interior of drum 70. Preferably, this method is performed with an expanding chuck or jig 108, or any other device for holding drum 70. As is illustrated in FIGS. 13 and 14, since insert 50 can be inserted while its outer diameter 66 is smaller than inner diameter 118 of drum 70, insert 50 can be inserted with zero insertion force, then expanded to an outer diameter 68 such that outer surface 82 of insert 50 comes into contact with inner surface 84 of drum 70.

Accordingly, in order to remove insert 50 according to any embodiment discussed herein, an axial force, as shown in FIG. 12, can be exerted against member 54, was represented for example by arrow 122, in order to release insert 50 into the interior of drum 70. Therefore, recycling of such a drum is greatly simplified over devices of the prior art which use adhesive to anchor an insert to the interior of the drum.

After insert 50 is disposed within drum 70, and end pieces 106 and 110 such as gear 106 and flange 110 are mounted to each end of the drum, the drum can then be rotatably mounted upon a shaft (if a shaft is utilized, and disposed within a process cartridge to be utilized in a photocopier or printer).

Figure 15:
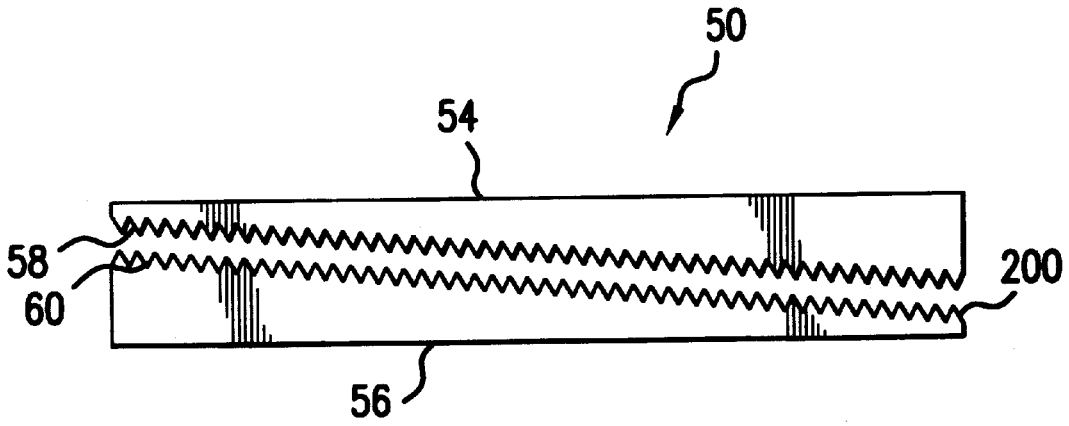
FIG. 15 is a side exploded view of an insert according to a further embodiment of the present invention.
Figure 16:
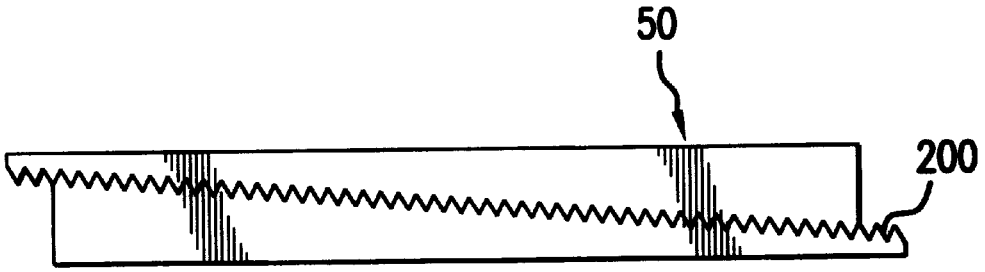
FIG. 16 is a side view of an assembled insert of the embodiment shown in FIG. 15.
Figure 17A:
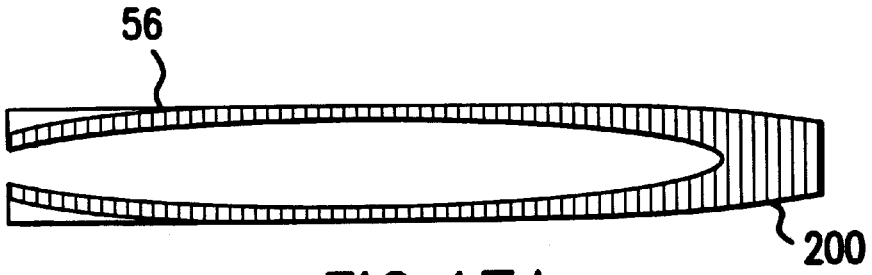
FIG. 17 is a view of the oblique surfaces of the insert shown in FIGS. 15 and 16.
Figure 17B:
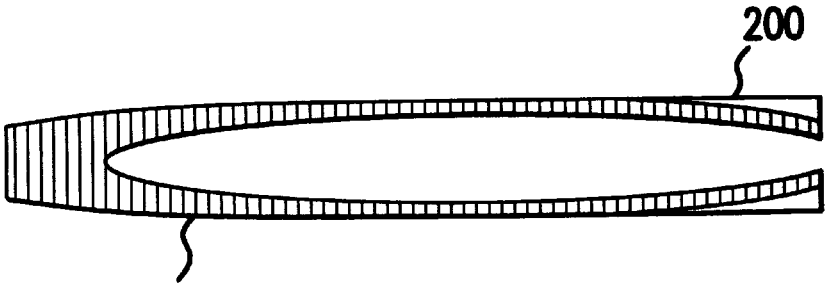

Referring now to FIGS. 15 through 17, a further embodiment of the present invention is shown therein. As shown in the figures, insert 50 includes at least one tooth 200 on each of oblique surfaces 58 and 60 of first and second members 54 and 56 of insert 50. In a presently preferred embodiment, surfaces 58 and 60 include a plurality of teeth 200. By providing at least one tooth 200 on each of surfaces 58 and 60, the insertion of insert 50 into a photoconductive drum is greatly simplified. For example, during insertion of insert 50 into a photoconductive drum, such as drum 70, it is desirable that a predetermined radially outward force is generated due to the relative longitudinal movement of first and second members 54 and 56. However, if surfaces 58 and 60 are smooth, the coefficient of friction between the first and second members 54 and 56 is likely to be less than 1, and the resulting outward force generated by the relative movement of first and second members 54 and 56 after insertion into the photosensitive drum 70 may vary from unit to unit. Therefore, by providing surfaces 58 and 60 with at least one tooth, the relative movement of first and second members 54 and 56 longitudinally with respect to each other will result in a clicking sound or vibration as teeth 200 move past each other.

For example, if each of surfaces 58 and 60 is provided with only one tooth provided at a predetermined position which corresponds to a predetermined desired radially outward force for particular insert 50 in a particular drum 70, first and second members 54 and 56 need only be moved relative to each other until the teeth engage with each other. Once the teeth 200 engage with each other, a worker installing insert 50 into drum 70 will recognize that the predetermined position has been achieved. However, in a presently preferred embodiment, first and second members 54 and 56 are provided with a plurality of teeth 200, thereby tending to provide more uniform contact between surfaces 58 and 60 and therefore more uniform contact between the outer peripheral surface 52 of insert 50 and the inner peripheral surface 84 of drum 70.

Figure 20:
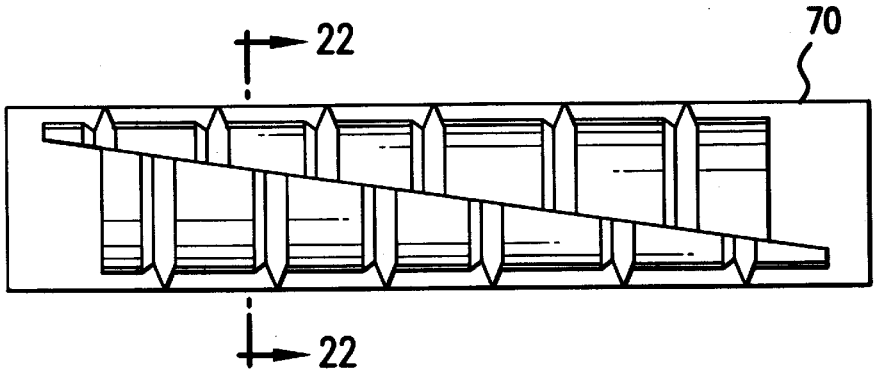
FIG. 20 is a partial section view of a photosensitive member with a side view of the insert shown in FIG. 19 inserted therein.
Figure 22:
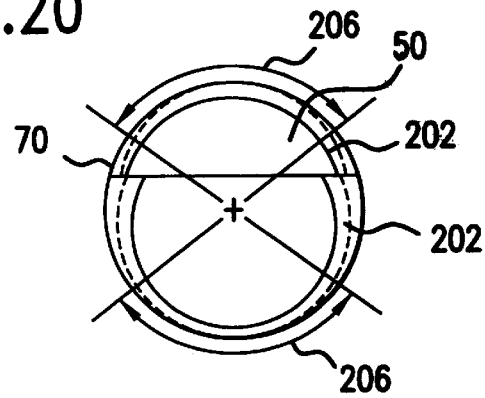
FIG. 22 is a section view taken along line 22.—22. of FIG. 20.

In a further embodiment of the present invention, insert 50 is provided with a plurality of annular ribs 202. Preferably, annular ribs 202 are deformable. Provided as such, when insert 50 with deformable ribs 202 is inserted into a drum 70, as shown in FIGS. 20 and 22, annular ribs 202 may deform and thereby generate a larger contact area between insert 50 and the inner circumferential surface 84 of drum 70.

Figure 21:
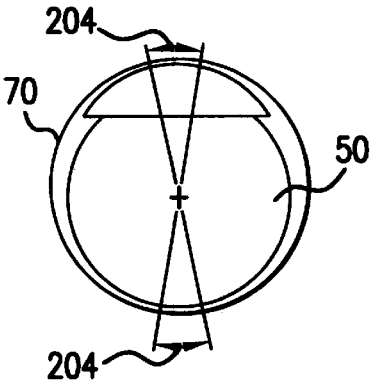
FIG. 21 is a simplified view of the insert shown in FIG. 14.

For example, referring now to FIG. 21, an insert 50 without annular ribs 202 is shown inserted into drum 70. As shown in the figure, the contact patch between the outer peripheral surface 52 of insert 50 generates a contact patch which covers approximately arcuate portion 204 of the inner peripheral surface 84 of drum 70. However, as shown in FIG. 22, when insert 50 is provided with deformable ribs 202, the contact patch generated between insert 50 and inner peripheral surface 84 of drum 70 may have an arcuate profile 206 even if the outer diameter of ribs 202, in a relaxed state, is smaller than the inner diameter of drum 70. Furthermore, if the outer diameter of ribs 202, in a relaxed state, is greater than the inner diameter 118 of drum 70, ribs 202 will contact the inner surface 84 of drum 70 around approximately the entire inner circumference of drum 70, while the relative movement of first and second members 54 and 56, having oblique surfaces 58 and 60, provides modulation of the radially outward force generated by insert 50.

Figure 23:
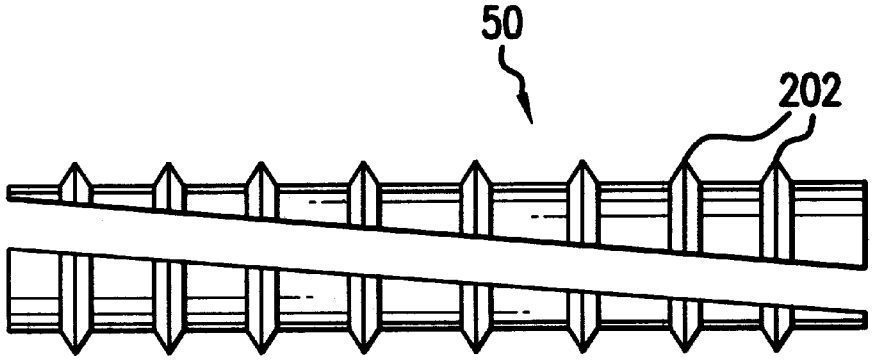
FIG. 23 is a side exploded view of a further embodiment of the first aspect of the present invention.
Figure 24:
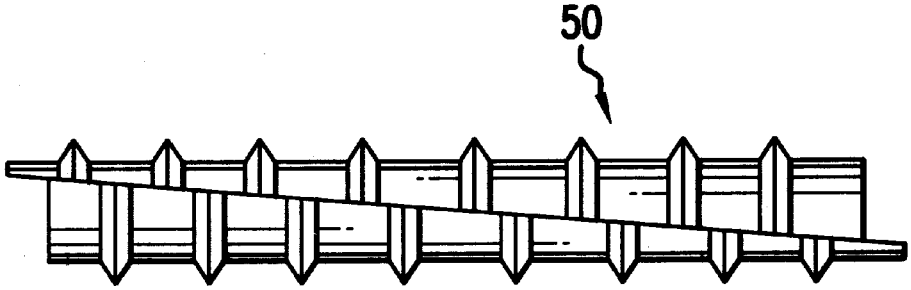
FIG. 24 is a side view of an assembled insert of the type shown in FIG. 23.

Similarly, FIGS. 23 and 24 show an embodiment of insert 50 having annular ribs 202 made of an elastomeric material provided on the outer peripheral surface 52 of insert 50.

Figure 18:
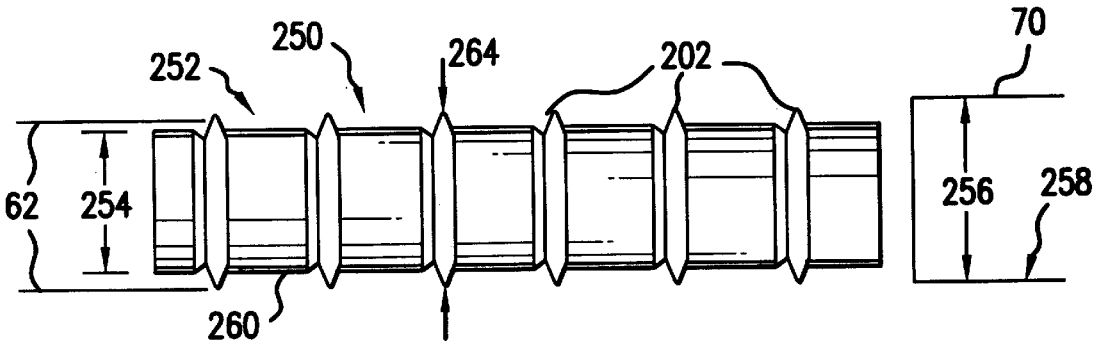
FIG. 18 is a side view of a further aspect of the present invention.
Figure 19:
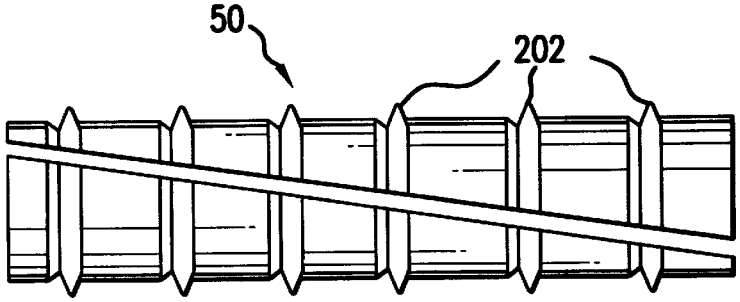
FIG. 19 is a side view of a further embodiment of the first aspect of the present invention.
Figure 25:
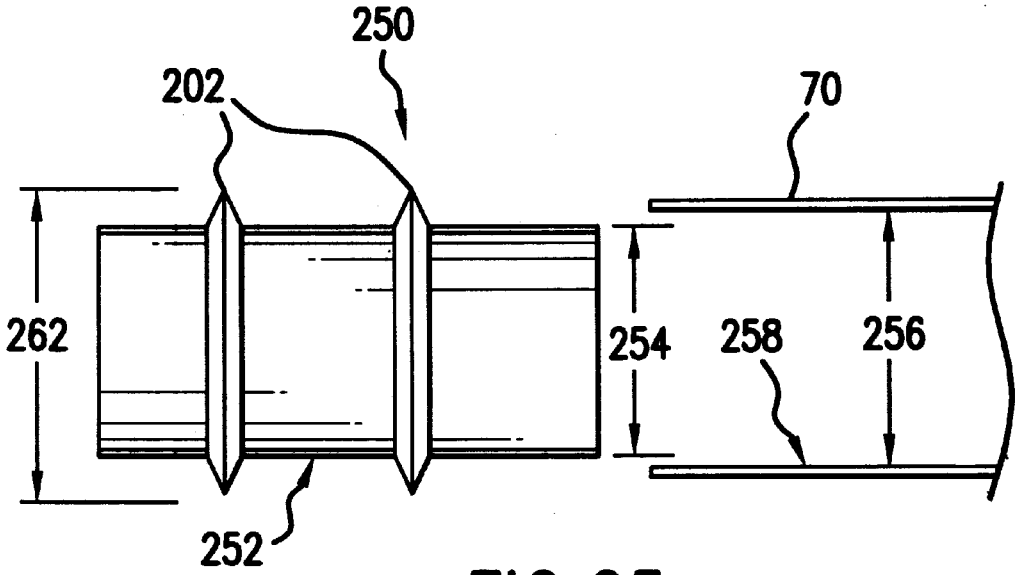
FIG. 25 is a further embodiment of the second aspect of the present invention.

According to a second aspect of the present invention, an insert 250 may be formed of a monolithic cylindrical member having a plurality of annular ribs 202 as shown in FIGS. 18 and 25. As shown in FIG. 18, insert 250 is formed of a monolithic tubular member 252 which has an outer diameter 254 which is less than the inner diameter 256 of drum 70. In order to provide contact between insert 250 and the inner surface 258 of drum 70, insert 250 includes a plurality of annular ribs 202 provided on its outer peripheral surface 260. In the embodiment shown in FIG. 18, annular ribs 202 are formed monolithically with tubular member 252, preferably in the same manner that annular ribs 202 are formed on insert 50, shown in FIG. 19. Preferably, annular ribs 202 have an outer diameter 262 which is, in a relaxed state, greater than the inner diameter 256 of drum 70. Provided as such, deformable annular ribs 202 can be inserted into drum 70 such that a radially outward force is generated by the deformation of annular ribs 202, thereby anchoring insert 250 into drum 70.

Preferably, annular ribs 202 are constructed so that their outer diameter 262 varies along the axial direction of the insert. For example, the ribs 202 located at the ends of the insert 250 are constructed so as to have an outer diameter 262 that is larger than the outer diameter 264 of ribs 202 towards the middle of insert 250. By constructing ribs 202 so that all of their outer diameters 262 and 264, in a relaxed state, are larger than the inner diameter 256 of the drum 70, and so that the outer diameter 262 of the ribs on the ends of insert 250 are larger than the outer diameters 264 of the ribs 202 towards the middle of insert 250, the insert allows the insertion force to be kept as low as possible, while ensuring a tight fit between insert 250 and the inner surface 258 of drum 70, and while ensuring contact between all of the ribs 202 and the inner surface 258 of drum 70 so as to reduce noise and vibration of the drum 70.

Similarly, insert 250 shown in FIG. 25 is formed of tubular member 252 having annular ribs 202, as discussed above, made of an elastomeric material. Preferably, tubular member 252 has an outer diameter 254 which is less than the inner diameter 256 of drum 70. Furthermore, outer diameter 262 of annular ribs 202 is greater than inner diameter 256 of drum 70, so that upon insertion into drum 70, annular ribs 202 deform and thereby generate a radially outward force against inner surface 258 of drum 70.

As discussed above, the present invention provides several important advantages over noise reducing inserts of the prior art. Firstly, by constructing a noise prevention device for insertion into a photosensitive drum with least two members which have opposed surfaces oblique with respect to the longitudinal axis of the photosensitive drum, the first and second members can be constructed and arranged in such a way that the outer diameter of the noise prevention device can be changed by moving the first and second members relative to each other. Constructed in this manner, the noise prevention device is selectively expandable so that, among other advantages, it can be inserted with zero insertion force, yet maintain its position within the photosensitive drum without adhesive. Therefore, the complication associated with using adhesive to bond an insert to the interior of a photosensitive drum are avoided and recycling of the drum is simplified since the insert may be removed relatively easily. Furthermore, since the insert can be inserted with zero insertion force, the drum is rendered more durable and less susceptible to deformation or deviation in roundness about the circumference of the drum.

Additionally, the noise reducing insert according to the second aspect of the invention also achieves important advantages over the inserts of the prior art. For example, by manufacturing the insert with a plurality of ribs that have an outer diameter, in a relaxed state, which is larger than the inner diameter of the photosensitive drum, the contact between the insert and the drum is limited to the ribs. Therefore, the friction generated between the inner surface of the drum and the ribs is much lower than that of the inserts of the prior art which have smooth outer surfaces and use an interference fit for securing the insert to the inner surface of the drum. Additionally, the construction of such an insert is quite simple and only requires one material. Furthermore, since only the annular ribs have an outer diameter which is equal to or greater than the inner diameter of the drum, the resulting radially outward force is limited to the areas of contact between the ribs and the drum, and is therefore less likely to produce deformation of the drum. Preferably, the ribs are constructed so that the outer diameter of the ribs varies along the axial length of the insert. For example, the outer diameter of the ribs at the ends of the insert are made larger than the outer diameter of the ribs towards the middle of the insert. Constructed in this way, the insertion force needed for inserting the insert into the drum is kept as low as possible, while the larger ribs at the ends of the insert ensure that there is a tight fit between the insert and the inner surface of the drum. In an alternative embodiment, any of the above-described annular ribs may be bonded to the exterior of the tubular member, wherein the annular ribs are made of an elastomeric material. By forming the annular ribs of an elastomeric material, sufficient anchoring of the insert within the drum may be achieved with generally less outward radial force since elastomeric material tends to deform and spread more readily than rigid materials, and thereby form large areas of contact with little pressure. Elastomeric ribs also tend to force air pockets out from between the ribs and the inner surface of the drum, thereby producing a slight suction effect between the ribs and the drum, and thereby enhancing the anchoring of the insert to the inner surface of the drum.

Obviously, numerous modifications and variations of the present invention are possible in light of the above teachings. It is therefore to be understood that, within the scope of the appended claims, the invention may be practiced otherwise and as specifically described herein.

What is claimed as new and desired to be secured by Letters Patent of the United States:

1. A photosensitive drum for an image forming apparatus comprising:

(a) a tubular photosensitive member having:
  (i) an outer photosensitive surface; and
  (ii) an inner surface;

(b) a noise prevention device comprising first and second members disposed inside of said tubular photosensitive member, wherein each of said first and second members are in contact with said inner surface of said tubular photosensitive member, each of said members including a surface oblique with respect to a longitudinal axis of said photosensitive drum.

2. A photosensitive drum as recited in claim 1, wherein each of said first and second members are formed in the shape of a wedge.

3. A photosensitive drum as recited in claim 2, wherein the oblique surfaces face each other, and wherein a reaction force directed from said tubular photosensitive member acting on said first and second members, is balanced by a frictional reaction force between said first and second members.

4. A photosensitive drum as recited in claim 3, wherein an adhesive is not required to hold the noise prevention device in place within the photosensitive drum.

5. A photosensitive drum as recited in claim 2, wherein said noise prevention device includes a third member interposed between the oblique surface of said first member and the oblique surface of said second member.

6. A photosensitive drum as recited in claim 5, wherein a reaction force directed from said tubular photosensitive member acting on said first and second members, is balanced by a frictional reaction force between said first and second members.

7. A photosensitive drum as recited in claim 1, wherein each of said first and second members have a longitudinal axis, wherein the oblique surface of said first member is substantially planar and oriented at a first angle oblique with respect to said longitudinal axis and the oblique surface of said second member is a second substantially planar surface oriented at a second angle oblique with respect to said longitudinal axis, and wherein the first and second planar surfaces face each other.

8. A photosensitive drum as recited in claim 7, wherein the first and second angles are substantially equal.

9. A photosensitive drum as recited in claim 7, wherein said first and second angles are of a magnitude such that the planar surfaces extend over substantially an entire length of said first and second members, respectively.

10. A photosensitive drum as recited in claim 1, wherein said noise prevention device extends over a majority of a length of said tubular photosensitive member.

11. A photosensitive drum as recited in claim 1, wherein said first and second members have an outer diameter less than a diameter of said inner surface of said tubular photosensitive member.

12. A photosensitive drum as recited in claim 1, wherein said first and second members are made of a resilient material, and have an outer diameter at least 0.005 inches less than a diameter of said inner surface of said tubular photosensitive member.

13. A photosensitive drum as recited in claim 1, wherein said first and second members are configured such that an overall diameter of said noise prevention device, as measured in a plane perpendicular to a longitudinal axis of said noise prevention device, is changed by moving said first and second members relative to each other along said longitudinal axis.

14. A photosensitive drum as recited in claim 1, wherein the oblique surfaces of said first and second members each includes at least one tooth.

15. A photosensitive drum as recited in claim 14, wherein said at least one tooth is provided at a position which corresponds to a predetermined relative position of said first and second members.

16. A photosensitive drum as recited in claim 14, wherein the oblique surfaces of said first and second members each includes a plurality of teeth uniformly distributed over the oblique surfaces.

17. A photosensitive drum as recited in claim 1, wherein at least one of said first and second members includes a plurality of ribs on an outer peripheral surface of said at least one of said first and second members.

18. A photosensitive drum as recited in claim 17, wherein said plurality of ribs is formed monolithically with said at least one of said first and second members.

19. A photosensitive drum as recited in claim 17, wherein said plurality of ribs are formed of an elastomeric material.

20. A method for reducing at least one of noise and vibration in an image forming apparatus comprising:

inserting a first member and a second member of an insert into a photosensitive member; and moving said first member relative to said second member so as to expand an outer circumference of the insert and such that an outer surface of the insert moves into contact with an inner surface of the photosensitive member.

21. A method as recited in claim 20, wherein in said step of inserting, the first and second members are wedge-shaped.

22. A method as recited in claim 21, wherein at least one of the first and second members includes a plurality of annular ribs, and wherein said step of moving further comprises moving the first and second members relative to each other until the annular ribs move into contact with the inner surface of the photosensitive member.

23. A method as recited in claim 21, wherein said step of moving further comprises moving the first and second members relative to each other until at least one tooth formed on each of the first and second members engage with each other.

24. A method as recited in claim 20, further comprising the step of:

arranging said first and second members such that an outer diameter of the insert is smaller than a diameter of the inner surface of the photosensitive member, before said step of inserting the first and second members.

25. A method as recited in claim 20, wherein said step of inserting comprises inserting the first member including a first wedge-shaped member with a first end member attached thereto, into a first end of the photosensitive member, an inserting the second member from a second end of the photosensitive member.

26. A method as recited in claim 25, wherein in said step of inserting, the first end member comprises any one of a gear and a flange.

27. A method as recited in claim 26, wherein no adhesive substance is used to bond any one of the first end member, the first member and the second member to the photosensitive member.

28. A method as recited in claim 20, wherein said step of moving includes expanding the outer diameter of the insert such that an adhesive is not required to hold the insert in place within the photosensitive member.

29. An image forming apparatus comprising:

(a) a photosensitive drum having an inner surface and an outer surface; and (b) an insert disposed inside of said photosensitive drum, said insert including first and second members, each of said members including a surface oblique with respect to a longitudinal axis of said photosensitive drum.

30. An image forming apparatus as recited in claim 29, wherein said first and second members are wedge-shaped.

31. An image forming apparatus as recited in claim 30, wherein each of said first and second members have an outer diameter which is less than an inner diameter of said photosensitive drum.

32. An image forming apparatus as recited in claim 29, wherein said first and second members are arranged such that an outer surface of said insert is in contact with said inner surface of said photosensitive drum, such that said insert exerts a force in a radially outward direction, against said inner surface of said photosensitive drum.

33. An image forming apparatus as recited in claim 30, wherein a reaction force of said force in said radially outward direction is balanced by a radially outward component of a frictional force between the oblique surfaces of said first and second members.

34. An image forming apparatus as recited in claim 29, wherein the oblique surfaces of said first and second members each includes at least one tooth.

35. An image forming apparatus as recited in claim 34, wherein said at least one tooth is provided at a position which corresponds to a predetermined relative position of said first and second members.

36. An image forming apparatus as recited in claim 34, wherein the oblique surfaces of said first and second members each includes a plurality of teeth uniformly distributed over the oblique surfaces.

37. An image forming apparatus as recited in claim 29, wherein at least one of said first and second members includes a plurality of ribs on an outer peripheral surface of said at least one of said first and second members.

38. An image forming apparatus as recited in claim 37, wherein said plurality of ribs is formed monolithically with said at least one of said first and second members.

39. An image forming apparatus as recited in claim 37, wherein said plurality of ribs are formed of an elastomeric material.

40. A photosensitive drum for an image forming apparatus comprising:

(a) a tubular photosensitive member having:

(i) an outer photosensitive surface; and (ii) an inner surface;

(b) a noise prevention device comprising a first member disposed inside of said tubular photosensitive member, said first member comprising a plurality of annular ribs provided on an outer surface of said first member, wherein an outer diameter of said plurality of ribs, in a relaxed state, is greater than an inner diameter of said inner surface of said tubular photosensitive member.

41. A photosensitive drum according to claim 40, wherein said plurality of annular ribs are monolithically formed on said noise prevention device.

42. A photosensitive drum according to claim 40, wherein said plurality of annular ribs includes first and second annular ribs formed respectively at first and second ends of said first member, said first and second annular ribs having first and second outer diameters respectively, and at least a third annular member having a third outer diameter, formed between said first and second annular ribs, wherein said first and second outer diameters are greater than said third outer diameter.

43. A photosensitive drum according to claim 40, wherein said first member comprises a tubular member having a cylindrical outer surface with an outer diameter that is less than said inner diameter of said tubular photosensitive member.

44. An image forming apparatus comprising:

(a) a photosensitive drum having an inner surface and an outer surface; and (b) a noise prevention device comprising a first member disposed inside of said photosensitive drum, said first member comprising a plurality of annular ribs provided on an outer surface of said first member, wherein an outer diameter of said plurality of annular ribs, in a relaxed state, is greater than an inner diameter of said inner surface of said photosensitive drum.

45. An image forming apparatus according to claim 44, wherein said plurality of annular ribs are monolithically formed on said noise prevention device.

46. An image forming apparatus according to claim 44, wherein said plurality of annular ribs includes first and second annular ribs formed respectively at first and second ends of said first member, said first and second annular ribs having first and second outer diameters respectively, and at least a third annular member having a third outer diameter, formed between said first and second annular ribs, wherein said first and second outer diameters are greater than said third outer diameter.

47. An image forming apparatus according to claim 44, wherein said first member comprises a tubular member having a cylindrical outer surface with an outer diameter that is less than said inner diameter of said photosensitive drum.

* * * * *